US006675865B1

(12) United States Patent
Yoshida

(10) Patent No.: US 6,675,865 B1
(45) Date of Patent: Jan. 13, 2004

(54) LOW MELTING POINT METAL MATERIAL INJECTION MOLDING METHOD, INJECTION MOLDING DEVICE AND BODY BOX

(75) Inventor: Tatsuo Yoshida, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/604,746

(22) Filed: Jun. 28, 2000

(30) Foreign Application Priority Data

Jun. 30, 1999 (JP) ..... P11-186807

(51) Int. Cl.[7] ..... B22D 17/00
(52) U.S. Cl. ..... 164/113; 164/119
(58) Field of Search ..... 164/113, 312, 164/119

(56) References Cited

U.S. PATENT DOCUMENTS

| | | | | | |
|---|---|---|---|---|---|
| 3,658,121 | A | * | 4/1972 | Douglas | 164/312 |
| 4,003,423 | A | * | 1/1977 | Shikinai et al. | 164/241 |
| 5,040,589 | A | * | 8/1991 | Bradley et al. | 164/113 |
| 5,580,507 | A | * | 12/1996 | Williamson et al. | 249/112 |
| 5,996,677 | A | * | 12/1999 | Woodhouse | 164/136 |
| 5,996,679 | A | * | 12/1999 | Pinnow et al. | 164/312 |
| 6,079,477 | A | * | 6/2000 | Woodhouse | 164/76.1 |

* cited by examiner

*Primary Examiner*—M. Alexandra Elve
*Assistant Examiner*—Len Tran
(74) *Attorney, Agent, or Firm*—Rader, Fishman & Grauer PLLC; Ronald P. Kananen

(57) ABSTRACT

The concave design forming unit with the desired form is formed on the surface of the molded component easily in the case of injection molding by using the low melting point metal material. A low melting point metal material for injecting the molten metal formed of low melting point metal material into the injection molding cavity of the predetermined shape provided in the metal mold, and after mold curing said molten metal, taking out the molded goods from the injection molding cavity; the injection molding cavity will be formed inside by the first metal mold unit and the second metal mold unit contacted and the metal mold having the trapezoidal concave design forming unit with the predetermined height formed on the metal mold inside surface of the first metal mold unit or the second metal mold unit forming said injection molding cavity will be heated to the prescribed metal mold temperature, and the molten metal heated to the predetermined molten temperature will be injected into the injection molding cavity of said heated metal mold at the predetermined injection rate, and after said molten metal injected is being chilled and solidified, separated into the first metal mold unit and the second metal mold unit and the molded component will be taken out from the injection molding cavity.

5 Claims, 7 Drawing Sheets

LOW MELTING POINT METAL MATERIAL INJECTION MOLDING METHOD, INJECTION MOLDING DEVICE AND BODY BOX

BACKGROUND OF THE INVENTION

1. Field of the Invention

The present invention relates to an injection molding method of low melting point metal material, injection molding device and box, and more particularly, is suitably applied to the case of injection molding the low melting point metal material that is the material of the box of the notebook personal computer (hereinafter referred to as notebook PC) for example.

2. Description of the Related Art

Heretofore, as shown in FIG. 1, the magnesium alloy of low melting point metal material has been commonly used for the body box 60 forming the outer part of a notebook PC 50. And by taking advantage of the feature of said magnesium alloy, the personal computer main body trimmed down to light weight and having increased hardness has been realized.

In the case of manufacturing such body box 60 of the notebook PC, by pouring the molten metal of magnesium alloy molten to the predetermined temperature at the predetermined injection rate into the predetermined shape injection molding space (hereinafter referred to as cavity) provided in the metal mold by using the injection molding device of hot chamber system, for example. And by taking out said injected molten metal from the metal mold after chilling and solidifying said injected molten metal as the molded goods, the box 60 having the same shape as the cavity can be manufactured.

Then, on the surface of thus manufactured box 60, the model name and logo marks are printed and mounted into the main body of the notebook PC and shipped as a merchandise.

However, since the model name and logo marks are displayed on the surface of the box 60 by printing, it was difficult to give the high quality impression and upscale quality feeling to the user by the box 60 of the notebook PC. Accordingly, in recent years it has been required to form the model name and logo marks with characters to be expressed with a slightly dented form with respect to the surface of the box 60 (hereinafter referred to as concave character).

As shown in FIG. 2, in the case of manufacturing a box equipped with concave characters (hereinafter referred to as box with concave characters) formed with the name of model type and logo mark using concave characters on the surface by using the hot chamber system injection molding device 1, a metal mold 11 having the shape wherein a cavity 2 formed by the left metal mold 3A and the right metal mold 3B corresponds to the box with concave characters will be used.

At this moment, the injection molding device 1 injects the molten metal of magnesium alloy molten to higher temperature than the metal mold 3 into the cavity 2 from the injection device 9. And after chilling and solidifying said injected molten metal, the right metal mold 3B is moved in the direction of an arrow C by the hydraulic cylinder 8 and the left metal mold 3A and the right metal mold 3B are separated and the molded goods is taken out from the cavity 2.

However, as shown in FIG. 3, the molten metal poured in the cavity 2 of the metal mold 3 reflects irregularly in the direction shown by an arrow at the convex part 4 provided corresponding to the concave characters to be formed on the surface of the box. And deviation occurs in the flow of molten metal poured into the cavity 2 and the molten metal does not flow constantly in the cavity 2, and thus the interference streaks occur on the surface of the box with concave characters after it is molded.

Moreover, in the injection molding device 1 of the hot chamber system, since the molten metal molten to higher temperature than the metal mold 3 is poured into the cavity 2 of the metal mold 3 heated to the predetermined temperature at the predetermined injection rate, the molten metal of high temperature runs against the convex part 4 severely.

Accordingly, in the injection molding device 1, the convex part 4 of the left metal mold 3A is further heated and deteriorated. Thus, the breakage occurs, such as the edge of the convex part 4 is chipped. Thus, in the box with the concave characters, after it is being molded by the injection molding device 1, an disadvantage occurs such as the contour of the concave character part becomes unclear due to the chipped edge of the convex part 4.

At the same time, in the injection molding device 1 of the hot chamber system, since the high temperature molten metal runs severely against the convex part 4 and said convex part 4 is further heated, the molten metal sticks onto the surface of the convex part 4 when cooling off the molten metal and solidifying this, and thus making the molded goods difficult to be taken out from the metal mold 3. And as a result, level difference occurs on the bottom surface of the concave character formed on the surface of the box with the concave characters.

Thus, in the conventional injection molding device 1, since such as interference streaks occur on the surface of the box with concave characters after being molded, disadvantages such as the contour of the concave character formed on the surface becomes unclear and the level difference occurs on the bottom surface, and the breakage such as chip occurs on the convex part 4 of the left metal mold 3A, it has been difficult to manufacture a large quantity of boxes with concave characters without defect, and this created a problem that yields of boxes with good quality were not good.

SUMMARY OF THE INVENTION

In view of the foregoing, an object of this invention is to provide an injection molding method of low melting point metal material capable of easily forming the desired shape concave design molding unit on the surface of the molded goods in the case of injection molding using the low melting point metal material, an injection molding device and a box provided with the concave design molding unit and having high quality.

The foregoing object and other objects of the invention have been achieved by the provision of an injection molding method of low melting point metal material, an injection molding device, and a box. In the injection molding method of low melting point metal material for injecting the molten metal formed of low melting point metal material into the injection molding cavity with the predetermined shape provided in the metal mold and after cooling off and solidifying the molten metal, taking out molded goods from the injection molding cavity; since the injection molding cavity is formed inside by the first metal mold unit and the second metal mold unit contacted, the metal mold having the trapezoidal shape convex design forming unit with the predetermined height on the metal mold inside surface of the first metal mold unit or the second metal mold unit forming the injection molding cavity is heated to the predetermined metal molding temperature, and the molten metal heated to the predetermined melting temperature is injected into the injection molding cavity in the metal mold heated, and after the injected molten metal is being cooled off and solidified, the molded goods is taken out from the injection molding cavity by separating the first metal mold unit and the second metal unit, the flow of the molten metal poured into the injection molding cavity would not be disturbed but can be poured in at a uniform rate because of the oblique side of the convex design forming unit having the trapezoidal shape. And thus, the concave design forming unit having clear contour corresponding to the convex design forming unit can be formed on the surface of the box easily.

Furthermore, according to the present invention, in the injection molding device for injecting the molten metal formed of low melting point metal material heated to the predetermined temperature into the injection molding cavity with the predetermined shape provided in the metal mold heated to the predetermined metal mold temperature and taking out the molded goods from the injection molding cavity after cooling off and solidifying the molten metal injected; since the metal mold forms an injection molding cavity inside by the first metal mold unit and the second metal mold unit contacted and the trapezoidal convex design molding unit with the predetermined height will be provided on the metal mold inside surface of the first metal mold unit or the second metal mold unit forming the injection molding cavity, the flow of molten metal poured into the injection molding cavity would not be disturbed because of the oblique side of the trapezoidal convex design molding unit and the molten metal can be poured into the cavity constantly and the concave design molding part having the clear contour corresponding to the convex design molding unit can be easily formed on the surface of the box.

Furthermore, according to the present invention, in the box for electronic equipment to be obtained by injecting the molten metal formed of low melting point metal material heated to the predetermined temperature into the injection molding cavity of the predetermined shape provided in the metal mold heated to the predetermined metal mold temperature at the predetermined injection speed, and after cooling off and solidifying the molten metal injected, for taking out the molded goods from the injection molding cavity, since the trapezoidal concave design forming unit having the oblique side tilted the predetermined angle to the virtual side normal to the surface towards the bottom side from the surface is provided, the static load strength and twisting strength will be increased and simultaneously, smooth touch and the feeling of high quality can be obtained by the oblique side having the trapezoidal tilted angle of the concave design forming unit.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiments of this invention will be described with reference to the accompanying drawings:

According to the present invention, by injection molding the magnesium alloy of the low melting point metal material as the material for a box to be used for the main body of the notebook PC by using the metal mold (to be described later), a box with concave characters on which characters to be shown by a slightly dented form (hereinafter referred to as concave characters) on the surface will be formed.

Here, the metal element single substance having the melting point lower than 650° C. or alloys based on these metals are called as the low melting point metal material; and such as aluminum, magnesium, zinc, tin, lead, bismuth, terbium, tellurium, cadmium, thallium, astatine, polonium, selenium, lithium, indium, sodium, potassium, rubidium, cesium, francium, gallium can be listed as low melting point metal materials. Especially, single substance of aluminum, magnesium, lead, zinc, bismuth, tin and alloys based on these metals are desirable.

These metal substances are metal elements or alloys that can be formed being mixed and molten at the injection molding device. These metal substances can be obtained by chipping the ingot with the chipping machine, and also chipped powders obtained by chipping using the chipping machine can be used. Furthermore, the metal substances can be formed by dropping the molten metal into the cooling-off medium such as water and also these metal substances can be obtained by using the reduction method, the rolling dissipation electrode method.

The metal substances to be obtained according to these methods are comparatively small and can be easily handled, different from powder and can be easily molten in the process of being transmitted into the metal mold of the injection molding device. In this connection, the case of utilizing the magnesium alloy of "AZ91D" according to the Japanese Industrial Standard (JIS) standard will be described as an example of the low melting point metal substances in the following paragraphs.

Figure 2:
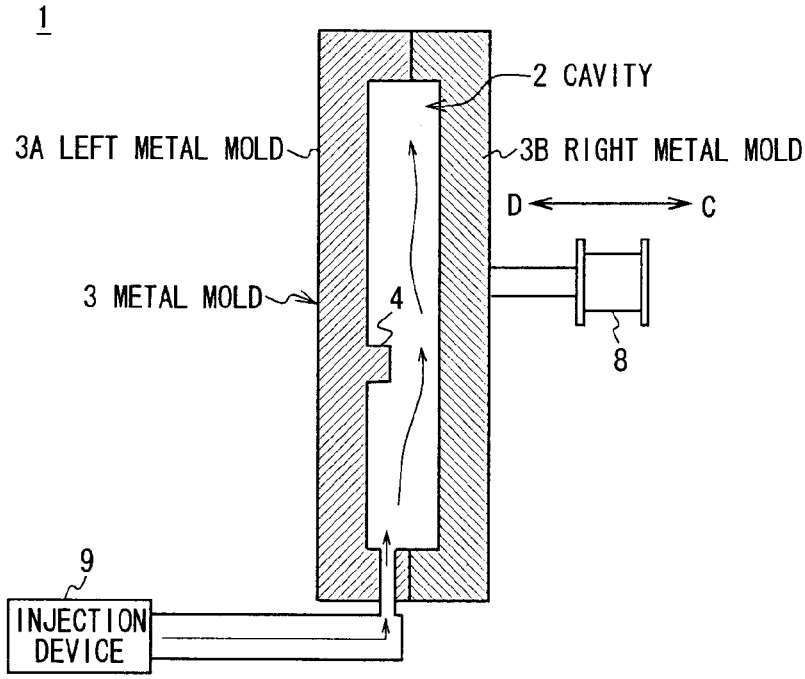
FIG. 2 (RELATED ART)
FIG. 2 is a brief linear diagram showing the construction of a conventional injection molding device.
Figure 3:
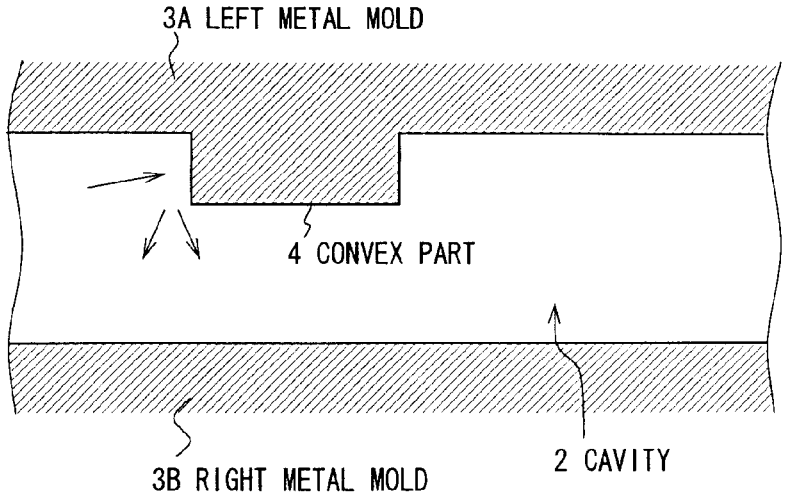
FIG. 3 (RELATED ART)
FIG. 3 is a brief linear cross sectional view illustrating the diffused reflection of the molten metal in the conventional injection molding device.
Figure 4:
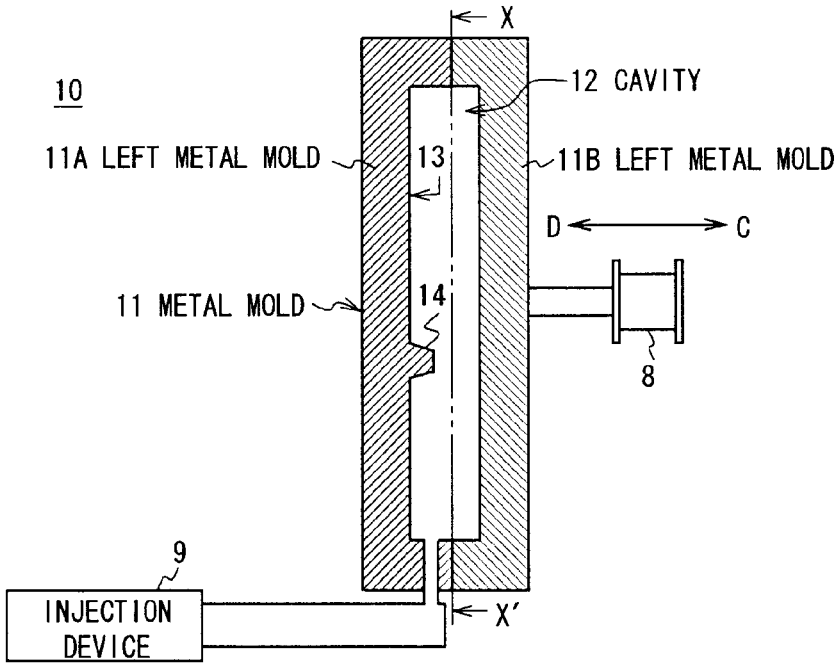
FIG. 4 is a brief linear diagram showing the cross-sectional Y–Y' construction of an injection molding device according to the present invention.
Figure 5:
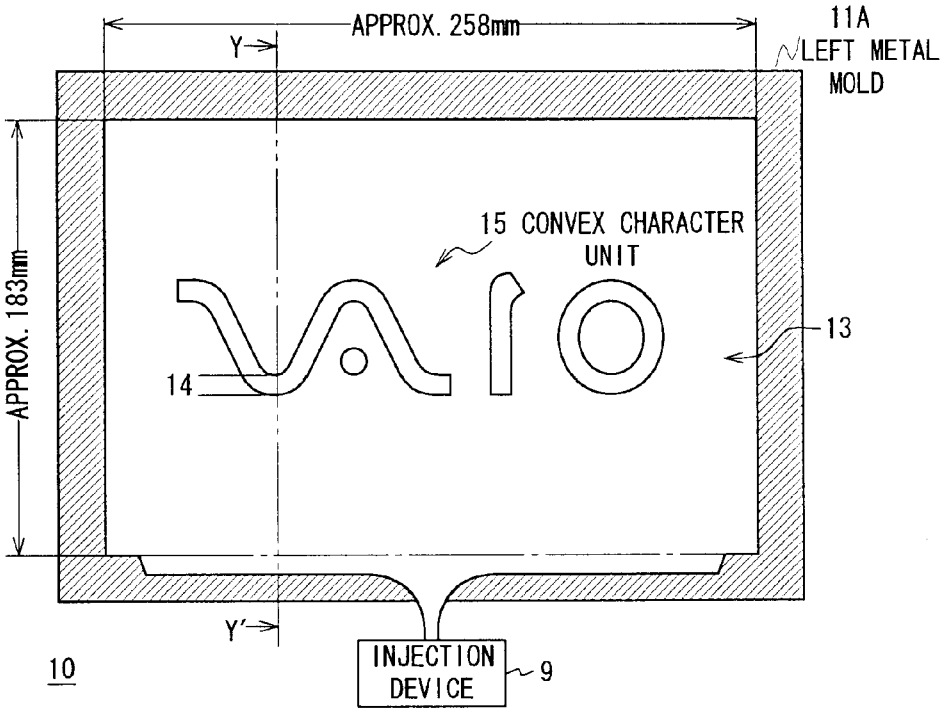
FIG. 5 is a brief linear diagram showing the cross-sectional X–X' construction of an injection molding device according to the present invention.

In FIGS. 4 and 5, in which corresponding parts of FIG. 2 are designated the same reference numerals, 10 generally shows an injection molding device of hot chamber system. FIG. 5 is a cross sectional view of the injection molding device 10 of FIG. 4 cutting through X–X' line. And FIG. 4 shows the condition of the injection molding device 10 of FIG. 5 cutting through Y–Y' line. More specifically, the injection molding device 10 of FIG. 5 is a front view of the metal mold surface 13 of the left metal mold 11A in the metal mold 11 observing from the inside of cavity 12. And molten metal of the low melting point metal substance can be injected into the cavity 12 from the injection device 9 of the lower part at a uniform rate.

In the injection molding device 10 (FIG. 5), convex character unit 15 ("VAIO") as the convex design forming unit formed by characters and graphics with the predetermined shapes corresponding to the concave characters to be formed on the surface of the box after it is molded at the center of the metal mold inside surface 13 in the left metal mold 11A slightly protruded from the metal mold inside surface 13. And this convex character unit 15 occupies approximately one third of the length of the metal mold inside surface 13 and nearly two third of the width of this metal mold inside surface 13 having the length approximately 183 mm×approximately 258 mm width.

In this case, trapezoidal convex part 14 corresponding to "V" of the convex character unit 15 is protruded from the metal mold inside surface 13 in the metal mold 11 (FIG. 4).

Figure 6:
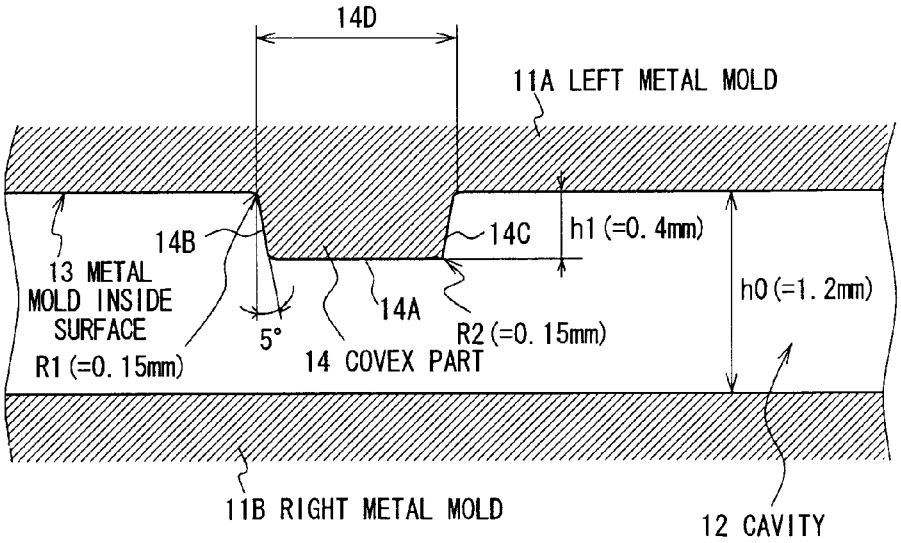
FIG. 6 is a brief linear cross-sectional view showing the construction of a metal mold.
Figure 7:
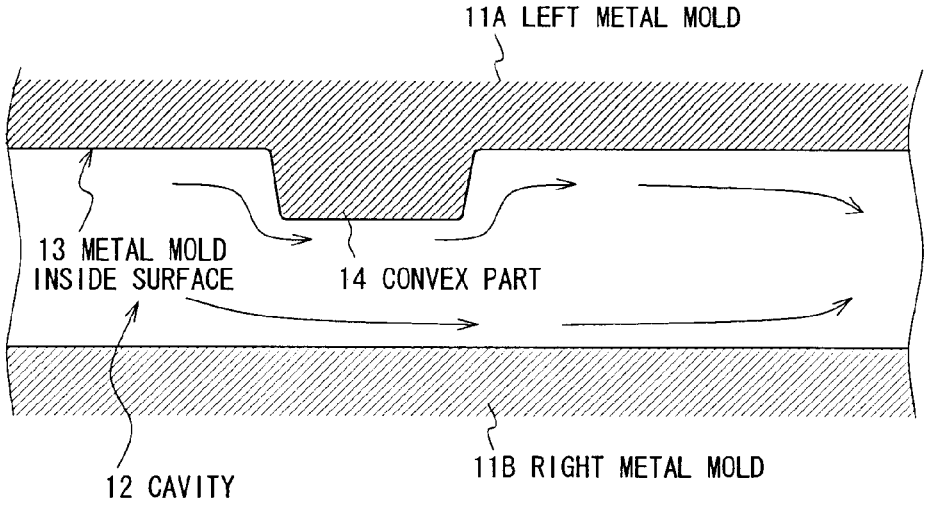
FIG. 7 is a brief linear diagram showing the flowing condition of molten metal in he cavity.

At this point, the size of the convex part 14 in the convex character unit 15 provided on the metal mold inside surface 13 of the left metal mold 11A and the space size of the cavity 12 to be formed by the fixed left side metal mold 11A as the first metal mold unit and the movable right side metal mold 11B as the second metal mold unit will be explained in detail referring to FIG. 6.

The trapezoidal convex part 14 formed on the outer surface of the left metal mold 11A, i.e., the metal mold inside surface 13, is formed with the height h1 (=0.44 mm) from the metal mold inside surface 13 to the upper bottom side 14A with respect to the space height of the cavity 12 h0 (=1.2 mm). And circular arc chamfers R1 (=0.15 mm) and R2 (=0.15 mm) are applied to the connecting part of the metal mold inside surface 13 and the oblique side 14B and 14C and the connection part of the oblique side 14B, 14A and the upper bottom side 14A respectively.

In practice, it is acceptable if the height of the trapezoid shape of the convex part 14 in the convex character unit 15 formed on the left metal mold 11 is formed within the range of 0.3 mm to 0.5 mm, and regarding the chamfers R1 and R2 (=0.15 mm), the radius of circular arc is formed within the range of 0.1 mm to 0.2 mm. More specifically, it may be agreeable if the height of trapezoid of the convex part 14 h1 occupies approximately 25 percent to 40 percent of the space height h0 of the cavity 12, and the radius of the circular arc of the chamfers R1 and R2 occupies 8 percent to 17 percent.

At the same time, the oblique sides 14B and 14C of the trapezoidal convex part 14 are tilted approximately 5 degrees with respect to the virtual side orthogonal to the metal mold inside surface 13, and the molten metal poured into the cavity 12 can easily flow into the cavity because of the inclination of the oblique sides 14B and 14C. Also in this case, it is agreeable if the oblique sides 14B and 14C are tilted approximately 4 to 6 degrees with respect to the virtual side orthogonal to the metal mold inside surface 13.

Accordingly, in the cavity 12 formed by the left metal mold 11A having the trapezoidal convex part 14 and the right metal mold 11B, the molten metal will be injected at a uniform rate without reflecting diffused at the convex part 14 since the convex part provided on the metal mold inside surface 13 is formed in trapezoidal shape having the oblique side 14B forming an obtuse angle to the molten metal to be poured in when the molten metal of magnesium alloy is poured into said cavity 12.

Accordingly, since the injection molding device 10 can pour the molten metal into the cavity 12 of the metal mold 11 at a uniform rate not disturbing the flow of said molten metal, the occurrence of interference streaks on the surface of the box after it is molded can be prevented. And since the molten metal can be poured into the cavity 12 at a uniform rate, the contour of concave characters after molded can be formed clearly.

At the same time, in the injection molding device 10, since the convex part 14 is formed in the trapezoidal shape, and an impactive force of the molten metal when running against the convex part 14 will be absorbed and become weaker due to the obtuse angle of the convex part 14, the convex part 14 can be prevented from being heated to high temperature. And thus, in the injection molding device 10, the molten metal can be prevented from attaching to the surface of the convex part 14 when it is cooled off and solidified. And thereby the occurrence of level difference on the bottom surface of the concave characters in the box with concave characters after it is formed can be prevented.

Furthermore, since the injection molding device 10 weakens the impactive force of the high temperature molten metal at the time when it hits against the convex part 14 by forming the obtuse angle, it can prevent the degradation of the convex part 14 due to the high temperature and the angle chipping of convex part 14. As a result, the injection molding device 10 can remarkably improve durability of the metal mold 11.

In practice, the injection molding device 10 heats the metal mold 11 to approximately 220° C., and under this condition, it injects the molten magnesium alloy molten to approximately 620° C. into the cavity 12 of the metal mold 11 from the injection device 9 at the injection speed of about 80 m/s. And after mold curing said injected molten metal in the cavity 12, moving the right metal mold 11B in the direction of an arrow C by the hydraulic cylinder 19, separates the left metal mold 11A and the right metal mold 11B and takes out the molded component, the box with concave characters from the metal mold 11.

Figure 8:
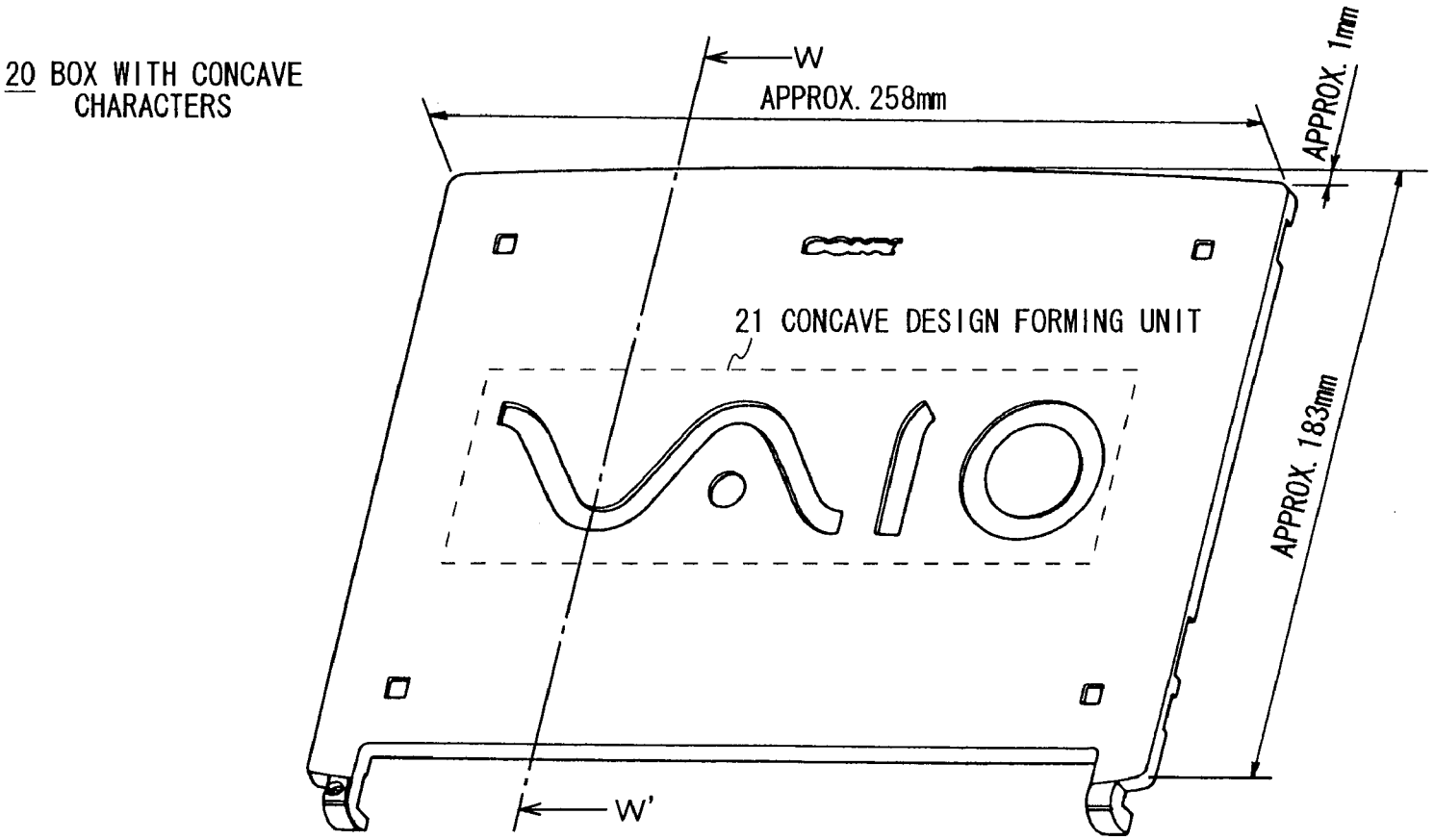
FIG. 8 is a brief linear perspective view showing a box with concave characters.

With this arrangement, as shown in FIG. 8, the box 20 having concave characters 20 obtained by injection molding using the cavity 12 of the metal mold 11 at the predetermined molten metal temperature and the predetermined injection speed by the injection molding device 10 is provided with the concave design forming unit 21 having concave characters corresponding to the convex character unit 15 (FIG. 5) formed on the metal mold inside surface 13 of the left metal mold 11A on its surface.

Figure 9:
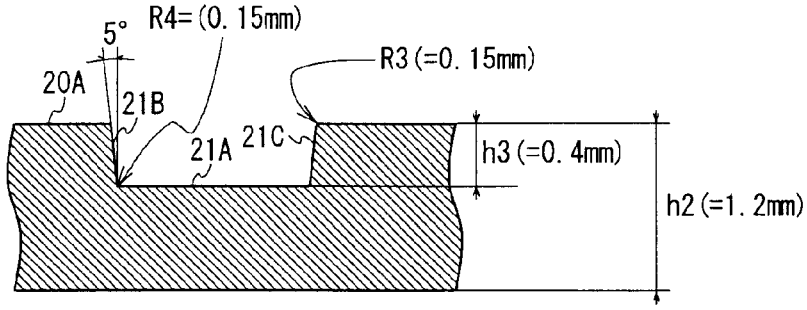
FIG. 9 is a brief linear cross-sectional view showing the cross-sectional construction of a box with concave characters.

As shown in FIG. 9, the cross sectional construction cutting across the line W–W' of this box equipped with concave characters has the same shape and size as the cavity 12 (FIG. 6) of the metal mold 11. And the character depth h3 from the surface 20A of the box with concave characters 20 to the bottom surface 21A of the concave design forming unit 21 (FIG. 8) formed with concave characters is (=0.4 mm) with respect to the box having the height h2 (=1.2 mm). Also the circular arc chamfers R3 (=0.15 mm) and R4 (=0.15 mm) are applied respectively to connecting parts of the oblique sides 21B and 21C and the bottom surface 21A.

However, since the box with concave characters 20 is molded corresponding to the space size of the cavity 12 of the metal mold 11, it may be acceptable that the character depth h3 (=0.4 mm) from the surface 20A of the box with concave characters 20 to the bottom surface 21A of the concave design forming unit 21 is formed within the range of 0.3 mm to 0.5 mm. And also regarding chamfers R3 and R4 (=0.15 mm), it may be acceptable if the radius of circular arc is formed within the range of 0.1 mm to 0.2 mm.

More specifically, it is agreeable if the character depth h3 from the surface 20A to the bottom surface 21A of the concave design forming unit 21 of the box with concave characters 20 is approximately 25 percent to 40 percent and the radius of circular arc in the chamfer parts R3 and R4 is approximately 8 percent to 17 percent of the box height h2.

Furthermore, the oblique sides 21B and 21C of the concave design forming unit 21 formed with concave characters are slanted approximately 5° with respect to the virtual side orthogonal to the surface 20A. And also in this case it is agreeable if these are tilted within the range of approximately 4 to 6 degrees.

According to the foregoing construction, at the time when injection molding, the injection molding device 10 uses the metal mold 11 comprising the fixed side left metal mold 11A equipped with a convex character unit 15 having the convex part 14 with the height h1 of approximately 25 percent to 40 percent of the space height h0 of the cavity 12, and to which chamfers R1 and R2 of approximately 8 percent to 17 percent relative to the space height h0 of the cavity 12 are applied and formed so that the oblique sides 14B and 14C would be tilted approximately 4 to 6 degrees with respect to the virtual side orthogonal to the metal mold inside surface 13, and the mobile side right metal mold 11.

Then, the injection molding device 10 injects the molten metal of magnesium alloy into the cavity 12 under the injection molding condition at the predetermined metal mold temperature, the predetermined molten temperature and the predetermined injection speed by using said metal mold 11 at the time of injection molding.

At this point, in this injection molding device 10, since the convex character unit 15 formed by the convex part 14 of trapezoidal shape is provided on the metal mold inside surface 13 of the fixed side left metal mold 11A forming the cavity 12, that is different from the conventional device, the molten metal of the magnesium alloy poured into the cavity 12 would not be reflected diffused but can be poured in at a uniform rate.

Furthermore, since the injection molding device 10 is provided with the trapezoidal convex part 14 on the metal mold inside surface 13 of the left metal mold 11A of the metal mold 11, the angle will become the obtuse angle when the molten metal of the magnesium alloy hits against the tilted side 14A of the convex part 14 when it is poured into the cavity 12 and the convex part 14 can be prevented from being over heated and being chipped due to the deterioration.

Accordingly, when the injection molding device 10 pours the molten metal into the cavity 12 of the metal mold 11, it can inject and pour in the molten metal at a uniform rate without disturbing the flow of said molten metal. And thus, the occurrence of interference streaks on the surface of the box with concave characters 20 can be prevented. And simultaneously, the contour of the concave design forming unit 21 can be formed clearly, and furthermore, the bottom surface 21A of the concave design forming unit 21 can be formed smoothly since chipping of the convex part 14 can be prevented.

With this arrangement, the injection molding device 10 becomes capable of mass producing the boxes with concave characters 20 on which the concave design forming unit 21 can be provided easily and without defect, and as a result, yields of high quality goods can be remarkably improved.

Figure 1:
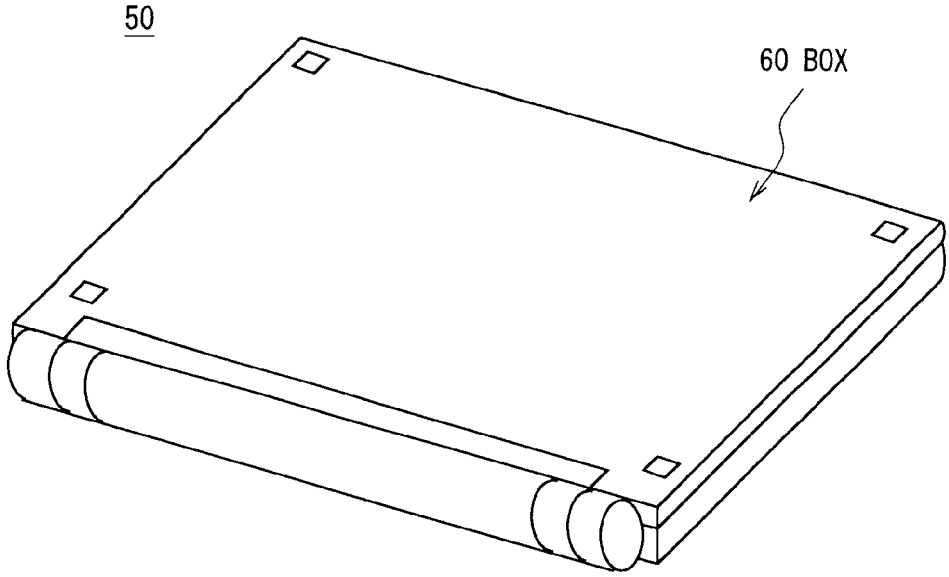
FIG. 1 (RELATED ART)
FIG. 1 is a brief linear diagram showing a box of the conventional notebook personal computer.
Figure 10:
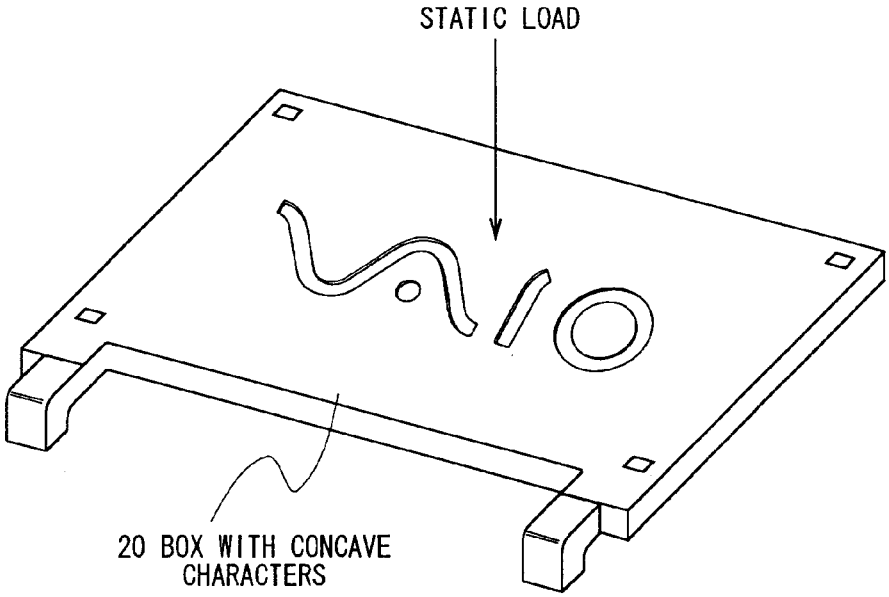
FIG. 10 is a brief linear diagram illustrating the load strength.

The box with concave character 20 thus injection molded is formed in the same shape and the same size as the cavity 12 of the metal mold 11. And since the concave design forming unit 21 occupies almost overall central area and plays a key role, the static load strength can be remarkably increased as compared with the flat shaped box 60 (FIG. 1) as shown in FIG. 10.

Furthermore, since the box with concave part 20 is provided with character parts of "V" and "A" of the concave design forming unit 21 assembled together in waveform, the twist strength will be increased. Moreover, the twist strength with respect to the direction orthogonal to the "I" character will be increased according to the character part of "I", and the twist strength with respect to all directions will be also increased according to the character part of "O".

Furthermore, since the concave design forming unit 21 of the box with concave character 20 has the trapezoidal shape corresponding to the convex design forming unit 15. And chamfers are applied to its edge parts, edges are not sharp but smooth to the touch, and thus adding the quality appearance to the user, the upscale image can be further improved.

According to the foregoing construction, since the injection molding device 10 pours the molten metal of the magnesium alloy into the cavity 12 of the metal mold 11 formed by the fixed side left metal mold 11A on which the convex design forming unit 15 having the trapezoidal convex part 14 is provided on the metal mold inside surface 13 and the mobile side right metal mold 11B, the molten metal can be regularly and constantly poured in not disturbing the flow because of the trapezoidal convex part 14 of the convex design forming unit 15. And simultaneously, the deterioration and chips due to overheating of the convex part 14 can be prevented. Thereby, the box with concave characters 20 on which the concave design forming unit 21 of the desired shape having clear contour but having no interference streaks on the surface can be easily manufactured.

Furthermore, the embodiment described above has dealt with the case of utilizing the hot chamber system injection molding device 10. However, the present invention is not only limited to this but also the injection molding device of cold chamber system and the injection molding device formed of various other systems can be used. In such cases, the same effects as those of the above embodiment can be obtained.

Furthermore, the embodiment described above has dealt with the case where the trapezoidal oblique sides 14B and 14C are slanted approximately 4 to 6 degrees with respect to the virtual side orthogonal to the metal mold surface 13. However, the present invention is not only limited to this but also approximately 8° and 10° can be acceptable. In short, if the flow of molten metal to be poured into the cavity 12 would not be disturbed, various other oblique angles can be acceptable.

Figure 11:
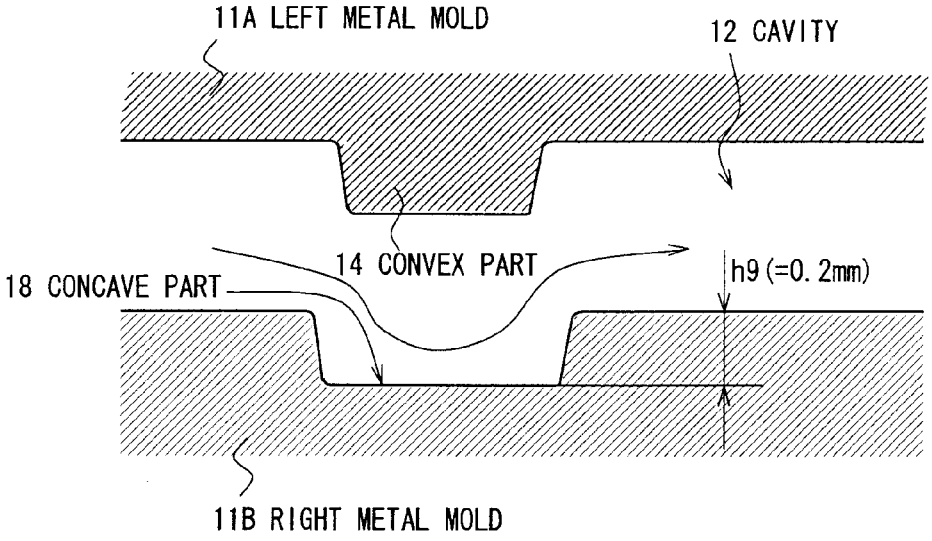
FIG. 11 is a brief linear cross sectional view showing the construction of a metal mold according to the other embodiment.

Furthermore, the embodiment described above has dealt with the case of forming the cavity 12 by the mobile side right metal mold 11B having flat surface and the fixed left metal mold 11A having the convex part 14 on the metal mold inside surface 13 as the cross sectional construction of the metal mold 11. However, the present invention is not only limited to this but also, as shown in FIG. 11, a new cavity 19 may be formed using the right metal mold 11B having the concave part 18 of the predetermined width with the predetermined depth h9 (=0.2 mm) at the position facing to the convex part 14. In this case, since the height between the convex part 14 and the concave part 18 becomes almost equal to the space height of the cavity 19, the molten metal can be further easily flown.

Furthermore, the embodiment described above has dealt with the case of using magnesium alloy as the material of the box with concave characters. However, the present invention is not only limited to this but also aluminum, zinc and a variety of other low melting point metal materials can be used.

Moreover, the embodiment described above has dealt with the case of injecting the molten metal of magnesium alloy molten to approximately 620° C. into the cavity 12 at the injection rate of approximately 80 m/s after heating the metal mold approximately to 220° C. by the injection molding device 10. However, the present invention is not only limited to this but also if the concave design forming unit 21 could be manufactured without defect, it can be injection molded under various other injection molding conditions.

Figure 12:
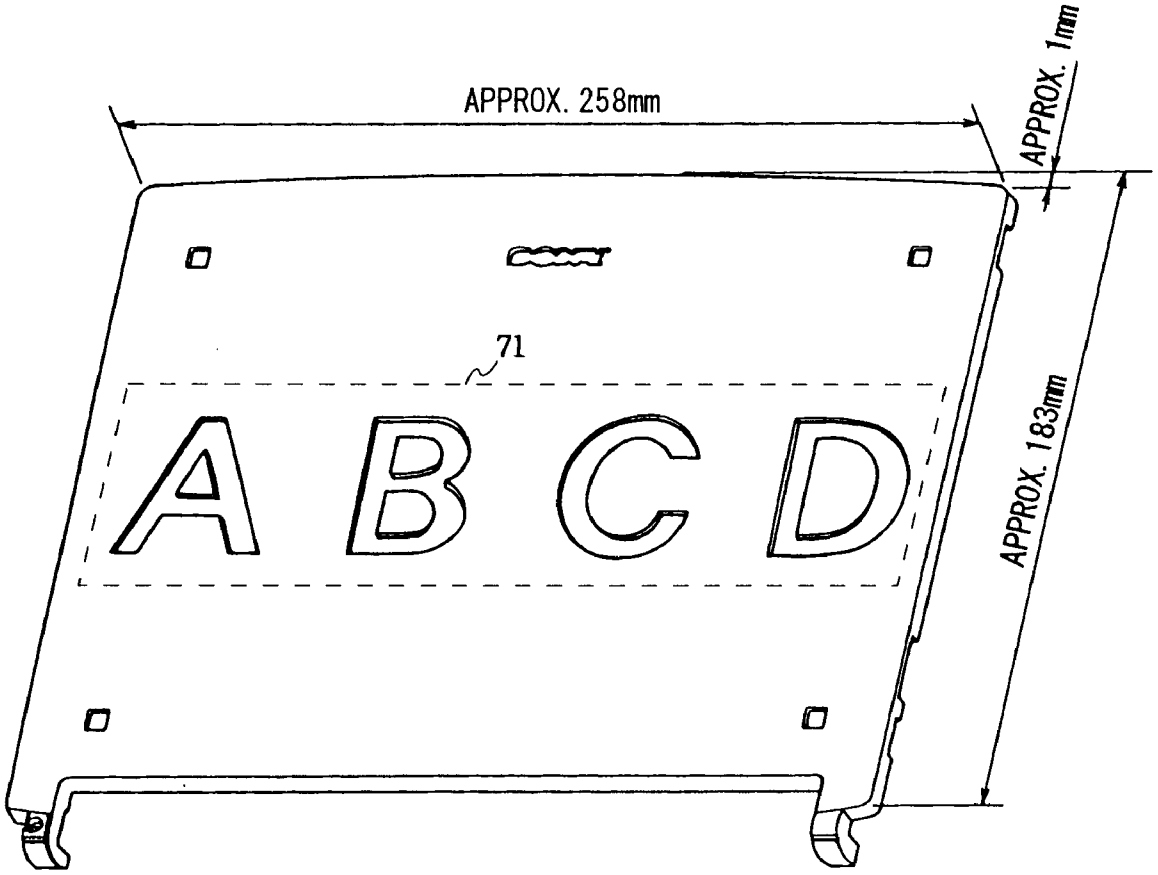
FIG. 12 is a brief linear perspective view showing a box with concave characters on which concave design forming unit is provided according to the other embodiment.

Moreover, the embodiment described above has dealt with the case of forming the concave design forming unit 21 of "VAIO" onto the concave character of the box with concave characters 20. However, the present invention is not only limited to this but also the concave design forming unit 71 may be formed with various other forms such as "ABCD" as shown in FIG. 12, provided that the strength of the same level as the static load strength and the twist strength of the box with concave characters 20 can be obtained.

Furthermore, the embodiment described above has dealt with the case of injection molding the box with concave characters 20 to be used for main body of the notebook PC by the injection molding device 10. However, the present invention is not only limited to this but also it may be applied to the case of injection molding the box with concave characters to be used for the main body of various other electronic equipments such as television set.

According to the present invention as described above, by constantly pouring the molten metal entered into the injection molding cavity without disturbing the flow of molten metal because of the oblique side of the trapezoidal shape convex design forming unit, the concave design forming unit having clear contour can be easily formed on the surface of the box. And thereby the injection molding method of low melting point metal material capable of easily forming the concave design forming unit of the desired form on the surface of molded component in the case of injection molding by using the low melting point metal material can be realized.

Furthermore, according to the present invention, by pouring the molten metal entered into the injection molding cavity at a uniform rate without disturbing the flow of the molten metal by the oblique side of the trapezoidal convex design forming unit, the concave design forming unit with clear contour corresponding to the convex design forming unit can be formed easily on the surface of the box. Thus, the injection molding device capable of easily forming the concave design forming unit with the desired form on the surface of the molded goods in the case of injection molding by using the low melting point metal material can be realized.

Furthermore, according to the present invention, since we provide the trapezoidal shape concave design forming unit provided on the surface of a box for electronic equipment to be obtained by injection molding with the predetermined depth and having the oblique side with the predetermined tilted angle with respect to the virtual side orthogonal to the surface from said surface to the bottom, the static load strength and twist strength will be increased, and at the same time the smooth touch and the high quality feeling can be obtained by the oblique side having the trapezoidal slanted angle of the concave design forming unit. Thereby, the box equipped with the concave design forming unit and having the smooth touch and high quality feeling can be realized.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. A metal injection molding method for forming an external case for a notebook personal computer with the external case having formed thereon a concave design pattern and being fabricated from either a metal or a metal alloy having a melting point of 650° C. or less, the metal injection molding method comprising the steps of:

providing a mold formed by a first die and a second die connected to each other to define an injection molding cavity sized to form the external casing, the first die defining a first die internal surface and the second die defining a second die internal surface disposed apart from one another by a height of the injection mold cavity forming a thickness of the external casing, at least one of the first and second dies including a design pattern forming portion for forming the concave design pattern, the design pattern forming portion projecting from the die internal surface of the at least one of the first and second dies at a design pattern forming portion height being in a range of approximately 25% to 40% of the height of the injection mold cavity, the concave design pattern forming portion having a trapezoidal-shaped as viewed in cross-section and including a sidewall having an inclination angle relative to a line extending perpendicularly to a base of the trapezoidal-shaped cross-sectional view with the inclination angle being in a range of approximately 3° and 5° in relation to the line that extends perpendicularly to the base, the concave design pattern forming portion including a first circular arc-shaped edge formed between the base and the sidewall with a first radius having a center of radius disposed internally of the concave design pattern forming portion and a second circular arc-shaped portion formed between the sidewall and the die internal surface of the at least one of the first and second dies with a second radius having a center of radius disposed in the injection molding cavity, each one of the first and second radii is in a range of approximately 8% and 17% of the height of the injection molding cavity;

heating the mold at a predetermined metal mold temperature;

heating the metal or metal alloy at a predetermined melting temperature to form a liquid molten state; and injecting the metal or metal alloy in the liquid molten state into the injection molding cavity at a predetermined uniform velocity.

2. An injection molding method according to claim 1, wherein the predetermined metal mold temperature is approximately 220° C.

3. An injection molding method according to claim 1, wherein the metal or metal alloy includes a magnesium alloy of code AZ91D according to the Japanese Industrial Standard (JIS).

4. An injection molding method according to claim 1, wherein the metal or metal alloy includes one of magnesium, aluminum, zinc, tin, lead, bismuth, terbium, tellurium, cadmium, thallium, astatine, polonium, selenium, lithium, indium, sodium, potassium, rubidium, cesium, francium, and gallium or an alloy based on any of magnesium, aluminum, zinc, tin, lead, bismuth, terbium, tellurium, cadmium, thallium, astatine, polonium, selenium, lithium, indium, sodium, potassium, rubidium, cesium, fracium, and gallium.

5. A metal injection molding method, comprising the steps of:

providing a metal mold having a first die and a second die connectable together to form an injection molding cavity defined by respective internal die surfaces of the first and second dies when the first and second dies are connected together, the respective internal die surfaces spaced apart from one another at a cavity height with at least one convex part integrally formed with the first die and projecting from the internal die surface thereof into the injection molding cavity, the at least one convex part having, as viewed in cross-section, a base section disposed from the internal die surface of the first die at a convex part height and a pair of sidewalls with each sidewall connected to and extending from the internal die surface of the first die by a first curved portion, each sidewall tapering inwardly toward the base section and connected to the base section by a second curved portion extending between a respective sidewall and the base section, the first curved portion having a first radius with a center of radius disposed in the injection mold cavity and the second curved portion having a second radius disposed internally of the at least one convex part;

heating the mold at a metal mold temperature of approximately 220° C.;

heating the metal or metal alloy at a predetermined melting temperature to form a liquid molten state; and injecting the metal or metal alloy in the liquid molten state into the injection molding cavity at a uniform velocity of approximately 80 meters per second wherein, the base section and each internal die surface is flat with each one of the flat base section and flat internal die surfaces being disposed in a respective plane extending parallel to each other and each sidewall tapers inwardly toward the base section at an inclination angle in relation to a line that extends perpendicularly to the base section in a range of approximately 3° and 5°, the convex part height is approximately 25% to 40% of the cavity height and each one of the first radius and the second radius is in a range of approximately 8% to 17% of the convex part height.

* * * * *